United States Patent [19]

Wilgus et al.

[11] 4,390,098

[45] Jun. 28, 1983

[54] AUTOMATIC CLOSURE REJECT FROM UPSTACKING DEVICE

[75] Inventors: William D. Wilgus; Earl L. Backes, both of Findlay, Ohio

[73] Assignee: Ball Corporation, Muncie, Ind.

[21] Appl. No.: 204,416

[22] Filed: Nov. 6, 1980

[51] Int. Cl.[3] ..... B07C 5/342

[52] U.S. Cl. ..... 209/571; 209/653; 209/928; 414/96

[58] Field of Search ..... 209/552, 597, 606, 651, 209/653, 928, 535-537, 571; 414/32, 92, 96

[56] References Cited

U.S. PATENT DOCUMENTS

| | | | |
|---|---|---|---|
| 2,361,960 | 11/1944 | Pelosi | 209/928 |
| 2,940,327 | 6/1960 | Gartner | 414/96 X |
| 2,991,879 | 7/1961 | Innocenti | 209/597 X |
| 3,034,645 | 5/1962 | Groppe | 209/536 |
| 3,342,350 | 9/1967 | Seragnoli | 414/96 X |
| 3,359,935 | 12/1967 | Rosbottom . | |
| 3,360,100 | 12/1967 | Seragnoli | 414/96 X |

*Primary Examiner*—Joseph J. Rolla
*Attorney, Agent, or Firm*—Gilbert E. Alberding

[57] ABSTRACT

Apparatus and a method of rejecting articles, such as can closures, are disclosed. The rejection of articles is obtained by variation in the length of a reciprocating member. In one mode of operation, a register of a multi-register counter is activated by an upstream sensor when a defective article is detected, and an actuator shortens the reciprocating member for a single upstroke after a prdetermined number of strokes of the reciprocating member to provide rejection of the defective article. In a second mode of operation, a predetermined number of articles are rejected upon every start-up of the apparatus to provide for rejection of questionable quality articles produced during start-up of the apparatus. In either mode of operation, the position of the variable length reciprocating stacking member can be determined by a proximity detector, to correctly time the lengthening or shortening of the variable length member.

27 Claims, 3 Drawing Figures

AUTOMATIC CLOSURE REJECT FROM UPSTACKING DEVICE

TECHNICAL FIELD

This invention relates to a method and apparatus for the rejection of articles from an upstacking device and more particularly to the rejection of defective metal container closures produced in a conversion press.

BACKGROUND OF THE INVENTION

Metal closures are produced by a rapid metal stamping operation, which forms the shell, followed by a multistep conversion operation during which the pull tab is formed and attached to the shell. In a standard conversion press the upper conversion die vertically reciprocates at over 300 cycles per minute while a conveyer holding closures in individual magazines, indexes the closures through the press in synchronized relation with a narrow width tab stock.

In one type of conventional press, after the conversion operation is completed, the finished closure continues being indexed forward in its individual magazine to an upstacking station. When the conveying belt stops for the next operation by the conversion die, a reciprocating stacking member moves upwards through the magazine in the conveying belt, and into contact with the bottom surface of the closure, pushing the closure upward into a receiving station. The reciprocating member then moves downward to a position below the conveying belt and the belt is indexed forward for the next conversion die operation.

Many presses have a testing station immediately upon exit from the press. A tab sensing means checks each closure for a tab to assure the press is properly operating. Upon encountering a closure without a tab, the press immediately shuts down so corrective action may be taken, which generally involves the rethreading of a new roll of tab stock into the press.

The tab stock is threaded through the press by "inching" the press forward at a very slow rate of speed until tab stock is present throughout the multiple stations. As the press is "inched" forward, closures which do not have pull tabs are exited from the press until the tab stock is threaded throughout the press. Removal of these defective closures between the exit of the press and the upstacking station is generally impossible due to lack of access and such removal must be delayed to a downline station where access to the closure line is more readily achieved.

Furthermore, due to the dynamics of the press operation and the design for high-speed operation of around 300 cycles per minute, it is often difficult to assure quality stability of the closures produced after threading and during start-up of the press until regular operating speeds are reached. Typically, in slow-speed operation, the press will provide a smaller depth scoreline around the removable portion of the closure thereby requiring higher opening forces to tear the pull tab from the closure.

In the past due to the difficulty in accessing closures between the exit of the press and the upstacking means, closures without pull tabs, and when desired, closures produced during start-up, have been manually removed from the production line downstream of the upstacking device.

This is generally done by marking the first bad closure with a colored ink and after starting the press and a period of operation, finding the marked closure as it passes an accessible downline location and removing it along with an estimated number of subsequently produced closures. This method is time consuming, messy, inefficient, wasteful and leaves room for error should the defective closures be missed or forgotten.

U.S. Pat. No. 2,361,960 to Pelosi, discloses an upstacker with reject means wherein rejection is accomplished by restraining the upward movement of the stacking member with a solenoid actuated pawl.

BRIEF DESCRIPTION OF THE INVENTION

In accordance with the present invention apparatus is provided to automatically reject a predetermined number of closures upon every start-up of the conversion press. Alternatively, where the production of closures requiring high-opening forces is not thought to be a problem during slow-speed operation, only those closures lacking pull tabs may be rejected. The reciprocating member is replaced with a variable length member which is capable of being shortened, upon being actuated by a control system, to disable the member from contacting closures indexed into the upstacking station. When in such a shortened state, closures are indexed through the stacking station, to the end of the conveyer, and into a reject bin, the stacking member continuing its reciprocating motion but disabled from contacting closures in the upstacking station due to its shortened length.

Where a predetermined number of closures are to be rejected upon start-up, the control system includes an actuating means, for actuating said variable length member to a shortened length and for actuating said member to an extended length, a counting means, and a means to sense stoppage of the conversion press. Upon stoppage of the press, the counting means is reset to zero and the actuating means actuates said variable length member to its shortened state. Upon starting the press, the counting means counts the number of cycles, and upon reaching a predetermined number, one closure being rejected per cycle, the actuating means actuates the variable length member to its extended length placing the stacking member in normal operation stacking closures in the receiving means.

Alternatively, if it is desired to only reject those closures having no pull tab, the control system must include a pull tab sensing means and a multiregister counter connected to said sensing means. The counter must have as many registers as there are stations between the sensing means and the upstacking means. Upon sensing a closure without a pull tab, one register of the counter is activated and starts to count press cycles. If a second closure is encountered without a pull tab, a second register of the counter is activated and so on. The actuator is programmed to shorten the variable length member, for one stroke, when a predetermined number of cycles are indicated on any register of the counter. The variable length member is immediately lengthened after the one upward stroke in the contracted mode unless the predetermined number again appears on one of the registers. The predetermined number will be the number of stations between the pull tab sensing means and the upstacking station.

Due to the small clearances available between the upstacker and the conveyer, and the rapid indexing movement of the conveyer, it is imperative that the variable length member be completely extended before it contacts a closure on the upward stroke or contract with sufficient speed such that the closure in the upstacking station is not contacted during the upstroke of the member. Should the variable length member be in some intermediate position on the upstroke, a closure may be pushed partially up into the receiving means without being retained therein. Upon the following indexing movement, the closure could be jammed between the conveyer or a subsequent closure and the receiving means resulting in damage to the device or at a minimum, lost time to clear the upstacking station. To assure proper timing in the actuation of the variable length reciprocating member, a proximity detector is provided to track the movement of the press, the conveyer, or the variable length member, all being in close synchronization and commonly driven. The actuator is programmed to actuate the variable length member to a change in mode only when, as indicated by the proximity detector, the member is on a downward stroke and at about 90 degrees from dead bottom. This gives the member the remaining 90 degrees downward and at least 90 degrees upward to attain a change in mode, which has generally been found to be sufficient.

BRIEF DESCRIPTION OF THE DRAWINGS

The operation of the present invention and the attendant advantages should be readily understood by reference to the following detailed description along with the appended claims when considered in conjunction with the accompanying drawings wherein:

DETAILED DESCRIPTION OF A PREFERRED EMBODIMENT

Figure 1:
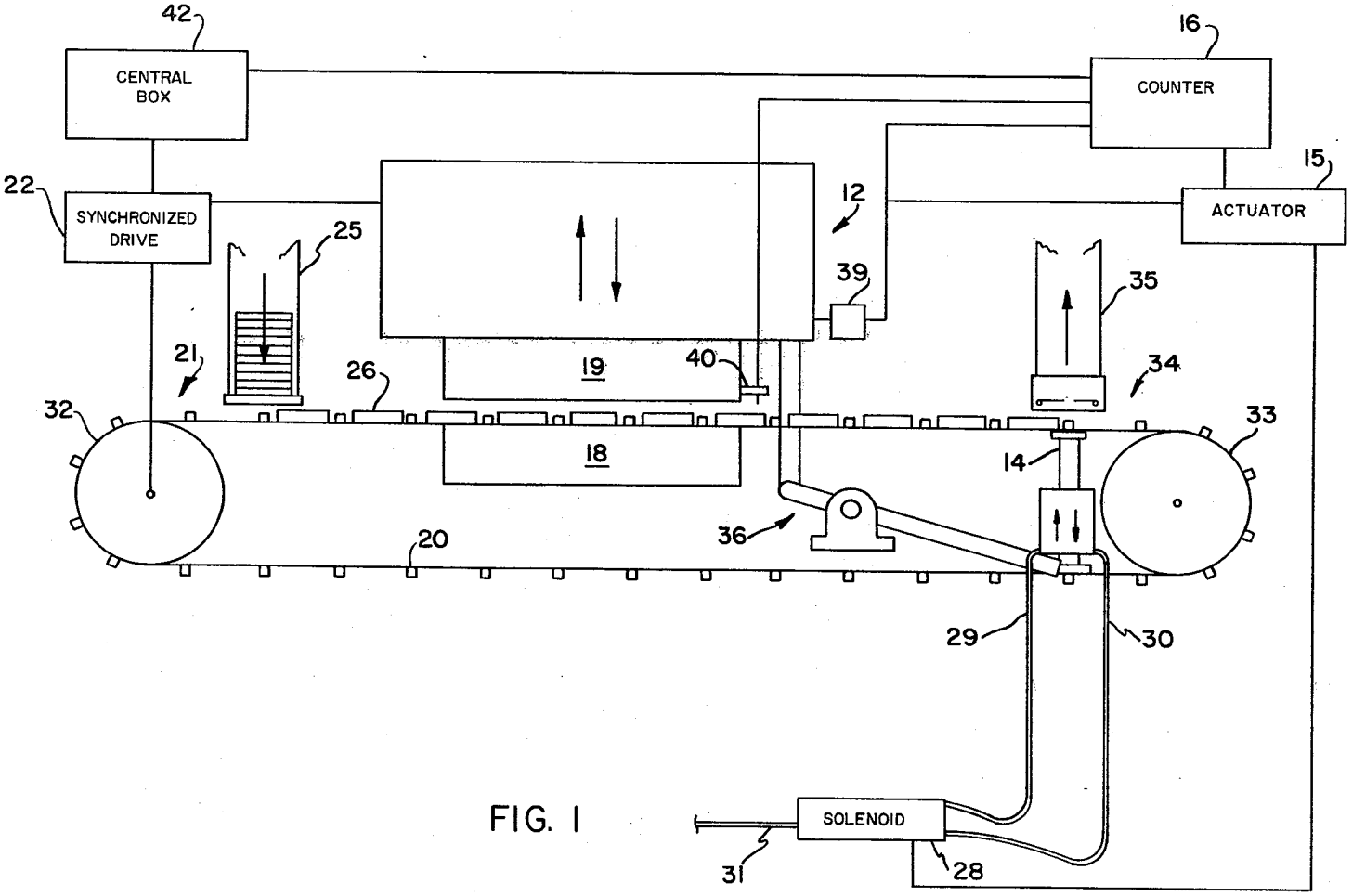
FIG. 1 is a diagrammatic representation of a conversion press in normal upstacking operation between working strokes.

Referring to the figures wherein like reference numerals designate like or corresponding parts throughout, and specifically referring to FIG. 1, there is shown a diagrammatic representation of a conventional conversion press 12, modified to incorporate an automatic reject means which includes a variable length reciprocating member 14, an actuator 15, and a cycle counting means 16.

The conversion press includes a reciprocating die 19; a stationary die 18; a conveyer 20, supported by drive wheel 32 and idler wheel 33; a series of magazines 21 carried by conveyer 20; a sychronized drive 22 for indexing said conveyer in synchronization in the reciprocating movement of said reciprocating die as shown schematically in the figures; a closure feed 25 for supplying closures to conveyer 20 in magazines 21; and an upstacking station 34 having a closure receiving means 35.

Figure 2:
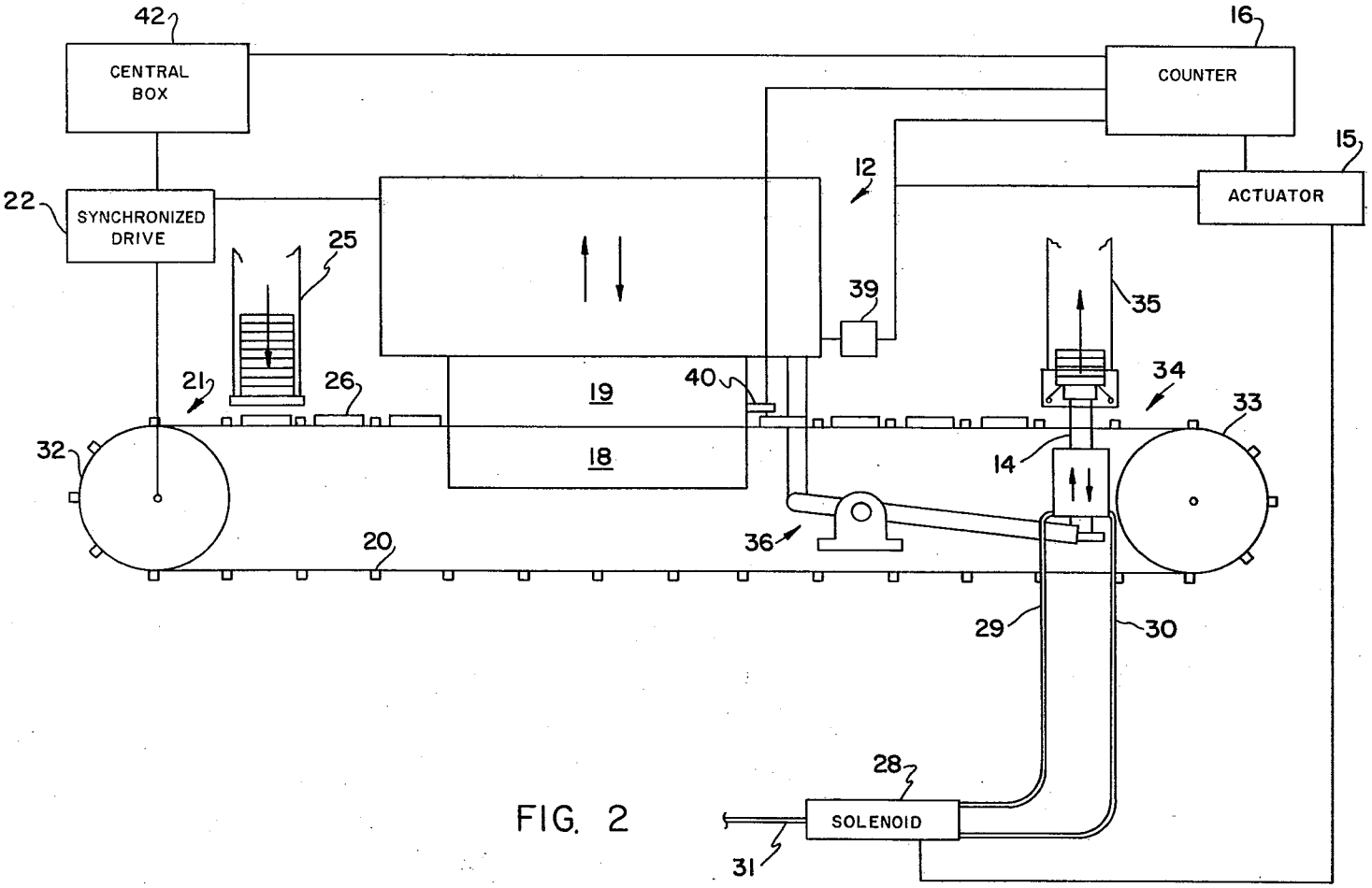
FIG. 2 is a diagrammatic representation of a conversion press in normal upstacking operation in a fully tooled position.

Normal operation of the conversion press is shown in FIGS. 1 and 2. The conveyer is continuously indexed forward in a stop-and-go fashion. Upon stoppage of the conveyer, the following events occur contemporaneously as shown in FIG. 2: a closure is fed into a magazine 26 from closure feed 25; the reciprocating die moves downward simultaneously working the series of closures and tab stock between it and stationary die 18; and reciprocating member 14 is driven upward by lever and pivot arrangement 36, pushing the closure in upstacking station 34 upward into receiving means 35. In normal operation, the conversion press continuously moves between the positions depicted in FIGS. 1 and 2 at the rate of about 300 complete cycles per minute.

Figure 3:
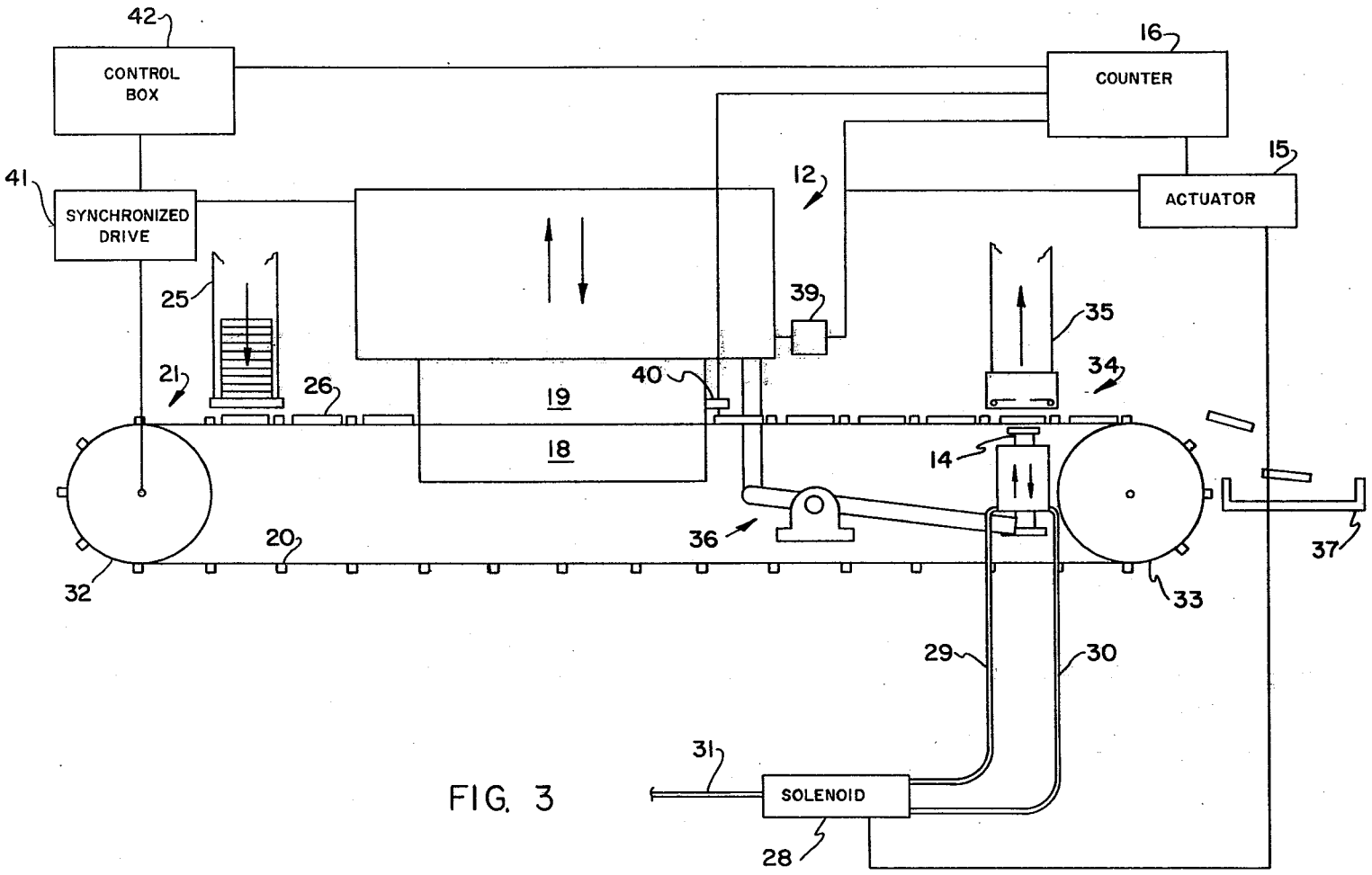
FIG. 3 is a diagrammtic representation of a conversion press in the reject mode of operation.

The reject operation of the press is illustrated in FIG. 3. Depending on the mode of operation the reject system is programmed for, upon the happening of certain to be described events, actuator 15 will actuate variable length member 14 to a retracted position. In the retracted position, as shown in FIG. 3, the reciprocating member is disabled from contacting closures on its upstroke and such closures are indexed through upstacking station 34 and into reject bin 37. The reciprocating member 14 continues its reciprocating motion but due to its shortened length, it is unable to contact closures in upstacking station 34.

In the preferred embodiment, variable length reciprocating member 14 is a double acting pneumatic cylinder which is connected to solenoid 28 by air hoses 29 and 30. Air hoses 29 and 30 are suitably constructed of a flexible material capable of withstanding the 300 cycles per minute reciprocating motion imparted to the cylinder. Solenoid 28 is connected to an air pressure supply 31.

Solenoid 28 is controlled by actuator 15 which determines which air hose, 29 or 30, is placed in communication with air pressure supply 31 thereby determining the extended or contracted mode of variable length reciprocating member 14.

The automatic rejector is operable in two different modes depending on the programming of counter 16 and actuator 15. In a first mode, the rejector automatically rejects a predetermined number of closures upon every start-up of the conversion press. In a second mode, only closures which are defective due to the absence of a pull tab are rejected.

In the first mode of operation, actuator 15 is programmed to retract variable length cylinder 14 upon counter 16 registering zero or upon the stoppage of the conversion press and to extend the variable length cylinder upon counter 16 registering a predetermined number of cycles. Counter 16 is programmed to reset to zero upon every stoppage of the conversion press as initiated by control box 42, and to count cycles, through its connection to proximity sensor 39, upon start-up of the press.

Therefore, in the first mode of operation, the following events occur: The press is stopped for any reason; Counter 16 is reset to zero and actuator 15 actuates solenoid 28 to retract variable length member 14 to its retracted mode. Upon start-up of the press, a predetermined number of closures pass through upstacking station 34 to reject bin 37. Upon counter 16 registering said predetermined number, actuator 15 actuates solenoid 28 to extend variable length member 28 to its extended or normal operating position thereby upstacking all subsequent closures into receiving means 35.

In the second mode of operation, counter 16 is a multiregister counter. A register of the counter is reset to zero and begins to count press cycles each time a closure is found to be absent a pull tab by pull tab sensor 40. There must be a minimum number of registers equivalent to the stations between the pull tab sensor and upstacking station 34. Actuator 15 is programmed to contract variable length member 14 whenever a predetermined number appears in one of the registers of counter 16. This predetermined number will be the number of stations between pull tab sensor 40 and upstacking station 34. After one stroke, the actuator extends the variable length member immediately, unless said predetermined number again appears in a register. In operation, this provides for rejection only of those closues not having pull tabs. This second operational mode will also work during the start-up of a press or during the "inching" function where a new roll of strip stock is being threaded and closures without pull tabs are being produced.

Due to the rapid operation of the press it is important that the contraction or extension of the variable length member be properly timed. If the member is only partially extended or contracted in an upstroke, a closure may be partially pushed upward but not secured by the receiving means resulting in breakage or jamming on the next forward index of the conveyer.

To ensure proper operation, actuator 15 is programmed to actuate solenoid 28, only when the press is in the proper position as indicated by proximity sensor 39. This will generally be when the press is on an upward stroke and the reciprocating member is correspondingly on a downward stroke. If the reciprocating member is actuated for a change in length at about 90 degrees from the top dead center of the press movement which corresponds to 90 degrees from the bottom dead center of the reciprocating member's movement, there will be sufficient time available for the member to completely extend or contract before coming into contact with a closure in the upstacking station.

Although proximity sensor 39 is shown monitoring reciprocating die 19, it may also monitor conveyer 20, reciprocating member 14, or synchronized drive 41, as all move in synchronization to one another, likewise, counter 16 may receive inputs from reciprocating die 19, conveyer 20, reciprocating member 14 or synchronized drive 41 with equally satisfactory results.

It is contemplated that other types of control systems and configurations, than that utilized in the above preferred embodiment, may be used without departing from the spirit or scope of the invention as defined by the following claims.

What is claimed is:

1. An upstacker with reject means comprising: means to index articles through an upstacking station; a receiving means positioned above said upstacking station and having means to retain articles placed therein from said upstacking station; a variable length member capable of reciprocating motion positioned such that in the extended mode, reciprocation of said member will bring the upper end thereof into said upstacking station and push said articles upward into said receiving station, while in the contracted mode, said member will reciprocate without contacting articles indexed into said upstacking station whereby said articles will be rejected by said means to index articles through said upstacking station; and actuating means to determine the mode of said variable length member.

2. The upstacker of claim 1 including means for counting the indexing cycles of said indexing means, said counting means being automatically resettable to zero upon stoppage of the upstacker and in communication with said actuating means and wherein said actuating means actuates the contracted mode of said variable length member upon stoppage of said upstacker and actuates the extended mode of said variable length member upon said counting means registering a predetermined number of indexing cycles.

3. The upstacker of claim 1 including: a means to test articles prior to said upstacking station; a multiregister counter in communication with said article testing means wherein a register of said multiregister counter is activated upon a signal from said testing means; and wherein said actuating means is programmed to automatically actuate the contracted mode of said variable length member upon a predetermined number appearing in any register of said multiregister counter and to actuate the extended mode of said variable length member after one reciprocation of said member in the contracted mode.

4. An upstacker with reject means comprising: means to index articles through an upstacking station; a receiving means positioned above said upstacking station and having means to retain articles placed therein from said upstacking station; a variable length member capable of reciprocating motion positioned such that in the extended mode, reciprocation of said member will being the upper end thereof into said upstacking station and push said articles upward into said receiving means, while in the contracted mode, said member will reciprocate without pushing said articles into said receiving means whereby said articles will be rejected by said means to index articles through said upstacking station; actuating means to determine the mode of said variable length member; a means to test articles prior to said upstacking station; a multiregister counter in communication with said article testing means wherein a register of said multiregister counter is activated upon a signal from said testing means; and wherein said actuating means is programmed to automatically actuate the contracted mode of said variable length member upon a predetermined number appearing in any register of said multiregister counter and to actuate the extended mode of said variable length member after one reciprocation of said member in the contracted mode.

5. The article upstacker of claim 4 including a proximity detector for determining the position of said variable length member and wherein said actuator is in communication with said proximity detector and actuates a change in mode at a predetermined position of said variable length member.

6. An article upstacker with reject means comprising: a means to index articles through an upstacking station; a receiving means positioned above said upstacking station and capable of retaining articles placed therein from said upstacking station; a variable length member capable of at least an extended and a contracted mode, said variable length member slidably mounted for vertical reciprocating motion and so constructed and arranged such that when said variable length member is in the extended mode the upper surface of said member will move from below said upstacking station up into said receiving station, and when in the contracted mode, the upper surface of said variable length member remains below said upstacking station; a reciprocating means attached to the lower portion of said variable length member and providing vertical reciprocating motion to said variable length member, said reciprocating means operating in timed relation to said indexing means; and means to actuate the desired mode of said variable length member whereby, when said variable length member is in the extended mode articles indexed to said upstacking station will be upwardly thrust into and retained by said receiving means while when said variable length member is in the contracted mode, articles placed in the upstacking station will be indexed through said station without contact by said variable length member.

7. The article upstacker of claim 6 including a means for counting the cycles of said indexing means in communication with said means to actuate, said counting means being automatically resettable to zero upon stoppage of said upstacker and wherein said actuator automatically actuates the contracted mode of said variable length member upon stoppage of said upstacker and automatically actuates the extended mode of said variable length member after a predetermined number of indexing cycles.

8. The upstacker of claim 6 including: a means to test articles prior to said upstacking station; a multiregister counter in communication with said article testing means; a register of said multiregister counter being actuated upon a signal from said testing means; and wherein said actuating means is programmed to automatically actuate the contracted mode of said variable length member upon a predetermined number appearing in any register of said multiregister counter and to actuate the extended mode of said variable length member after one reciprocation of said member.

9. An article upstacker with reject means comprising: a means to index articles through an upstacking station; a receiving means positioned above said upstacking station and capable of retaining articles placed therein from said upstacking station; a variable length member capable of at least an extended and a contracted mode, said variable length member slidably mounted for vertical reciprocating motion and so constructed and arranged such that when said variable length member is in the extended mode, the upper surface of said member will move from below said upstacking station up into said receiving means, and when in the contracted mode, the upper surface of said variable length member remains below said upstacking station; a reciprocating means attached to the lower portion of said variable length member and providing vertical reciprocating motion to said variable length member, said reciprocating means operating in timed relation to said indexing means; means to actuate the desired mode of said variable length member whereby, when said variable length member is in the extended mode, articles indexed to said upstacking station will be upwardly thrust into and retained by said receiving means while when said variable length member is in the contracted mode, articles placed in the upstacking station will be indexed through said station without contact by said variable length member; a means to test articles prior to said upstacking station; a multiregister counter in communication with said article testing means; a register of said multiregister counter being actuated upon a signal from said testing means; and wherein said actuating means is programmed to automatically actuate the contracted mode of said variable length member upon a predetermined number appearing in any register of said multiregister counter and to actuate the extended mode of said variable length member after one reciprocation of said member.

10. The article upstacker of claim 9 including a proximity detector for determining the position of said variable length member and wherein said actuator is in communication with said proximity detector and actuates a change in mode at a predetermined position of said variable length member.

11. A conversion press with automatic reject means comprising: a conversion press capable of forming a tab and attaching same to a closure through a multistep operation; a conveying means having uniformly spaced apart magazines to carry closures through said conversion press; an indexing drive means capable of indexing said conveying means in timed relation to the strokes of said conversion press; an upstacker located along said conveying means, said upstacker having a receiving means positioned above said conveying means and a reciprocating variable length stacking member operating in timed relation to said conveying means, said stacking member capable of assuming at least a first and second length, said first length being the normal operational length such that said stacking member contacts a closure and pushes it upward into said receiving station, said second length being shorter than said first length such that said stacking member is disabled from contacting closures; and an actuating means to determine said first or second length.

12. The conversion press of claim 11 including a counter for counting press cycles, said counter being automatically resettable upon stoppage of said press and wherein said actuating means is programmed to determine said second length upon stoppage of said press and said first length after a predetermined number of press cycles.

13. The conversion press of claim 11 including: a tab sensor for signaling the absence of a tab; a multiregister counter in connection with said tab sensor, said counter having a register activated upon a signal from said tab sensor; and wherein said actuating means is programmed to determine said second length upon a predetermined number appearing in any of the registers of said counter and to determine said first length after a single reciprocation of said variable length member.

14. A conversion press with automatic reject means comprising: a conversion press capable of forming a tab and attaching same to a closure through a multistep operation; a conveying means having uniformly spaced apart magazines to carry closures through said conversion press; an indexing drive means capable of indexing said conveying means in timed relation to the strokes of said conversion press; an upstacker located along said conveying means, said upstacker having a receiving means position above said conveying means; and a reciprocating variable length stacking member operating in timed relation to said conveying means, said stacking member capable of assuming at least a first length and a second length, said first length being the normal operational length such that said stacking member contacts a closure and pushes it upward into said receiving station, said second length being shorter than said first length such that said stacking member is disabled from contacting closures; an actuating means to determine said first length or second length of said stacking member; a tab sensor for signaling the absence of a tab; a multiregister counter in connection with said tab sensor, said counter having a register activated upon a signal from said tab sensor; and wherein said actuating means is programmed to determine said second length upon a predetermined number appearing in any of the registers of said counter and to determine said first length after a single reciprocation of said variable length member.

15. The conversion press of claim 14 including a proximity detector, in connection with said actuating means, for determining the position of said conversion press and wherein said actuating means is programmed to determine a change in length of said variable length stacking member at a predetermined position.

16. A method of rejecting closures produced during the start-up of a conversion press, said conversion press performing a multiple step operation on a closure being indexed therethrough, a completed closure being indexed through an upstacking station wherein a reciprocating member contacts the bottom side of the closure and pushes it upward into a receiving station, comprising the steps of: stopping said conversion press; shortening said reciprocating member sufficiently to disable said member from contacting said closure; starting said conversion press; indexing closures through the upstacking device; counting the number of cycles of said conversion press; and lengthening said reciprocating member after a predetermined number of cycles.

17. The method of claim 16 including the step of monitoring the position of said reciprocating member and wherein said lengthening step is performed when said reciprocating member is at a predetermined position.

18. A method of rejecting defective closures from a conversion press, said conversion press performing a multistep tab forming and attachment operation to closures being indexed therethrough, the completed closures being indexed through an upstacking station wherein a reciprocating member contacts the bottom side of a closure and pushes it upward into a receiving station, comprising the steps of: testing for the presence of a tab on the completed closures; activating a counting means upon the testing of a defective closure; shortening said reciprocating member upon the appearance of a predetermined number in said counting means; and lengthening said member after a single reciprocation.

19. The method of claim 18 including the step of monitoring the position of said reciprocating member and wherein said lengthening and shortening steps are performed when said reciprocating member is at a predetermined position.

20. An article-rejecting apparatus, comprising a conveyor including a station at which articles are to be rejected, a reciprocating, article-engaging, piston-cylinder mechanism at said station operable by a pressurized fluid between at least two positions, one of said two positions being with the piston extended from the cylinder and another of said positions being with the piston retracted in the cylinder, said cylinder being connected with a source of pressurized fluid, an actuating means including a valve connected between the source of pressurized fluid and the cylinder to control the flow of pressurized fluid to the cylinder and the position of the piston in the cylinder, and a control to operate the valve of the actuating means to effect one position of the piston to reject articles at said station and to effect another position of the piston when articles are not to be rejected.

21. The apparatus of claim 20 including a reciprocating conversion press to form the articles by means of a reciprocating die, and a mechanism driven by the reciprocating press and reciprocating the article-engaging, piston-cylinder mechanism in synchronism with the reciprocating die and a sensor included in said control to differentiate between articles satisfactorily formed by said reciprocating die and articles to be rejected.

22. A method of rejecting articles from an upstacking device, said upstacking device having a means to index articles therethrough and a member that reciprocates which contacts the bottom of said articles and pushes them upward into a receiving station, comprising the steps of: shortening said reciprocating member sufficiently to disable said member from contact with the bottom of said articles; and indexing said articles out of said upstacking device to a reject station.

23. An upstacker with reject means comprising: means to index articles through an upstacking station; a receiving means positioned above said upstacking station and having means to retain articles placed therein from said upstacking station; a variable length member capable of reciprocating motion positioned such that in the extended mode, reciprocation of said member will bring the upper end thereof into said upstacking station and push said articles upward into said receiving means, while in the contracted mode, said member will reciprocate without pushing said articles into said receiving means whereby said articles will be rejected by said means to index articles through said upstacking station; actuating means to determine the mode of said variable length member; means for counting the indexing cycles of said indexing means, said counting means being automatically resettable to zero such stoppage of the upstacker and wherein said actuating means actuates the contracted mode of said variable length member upon stoppage of said upstacker and actuates the extended mode of said variable length member upon said counting means registering a predetermined number of indexing cycles; and a proximity detector for determining the position of said variable length member, said proximity detector being in communication with said actuating means to effect a change in mode at a predetermined position of said variable length member.

24. An article upstacker with reject means comprising: a means to index articles through an upstacking station; a receiving means positioned above said upstacking station and capable of retaining articles placed therein from said upstacking station; a variable length member capable of at least an extended and a contracted mode, said variable length member slidably mounted for vertical reciprocating motion and so constructed and arranged such that when said variable length member is in the extended mode, the upper surface of said member will move from below said upstacking station up into said receiving means, and when in the contracted mode, the upper surface of said variable length member remains below said upstacking station; a reciprocating means attached to the lower portion of said variable length member and providing vertical reciprocating motion to said variable length member, said reciprocating means operating in timed relation to said indexing means; means to actuate the desired mode of said variable length member whereby, when said variable length member is in the extended mode, articles indexed to said upstacking station will be upwardly thrust into and retained by said receiving means while when said variable length member is in the contracted mode, articles placed in the upstacking station will be indexed through said station without contact by said variable length member; a means for counting the cycles of said indexing means in communication with said means to actuate, said counting means being automatically resettable to zero upon stoppage of said upstacker and wherein said actuator automatically actuates the contracted mode of said variable length member upon stoppage of said upstacker and automatically actuates the extended mode of said variable length member after a predetermined number of indexing cycles; and a proximity detector for determining the position of said variable length member, said proximity detector being in communication with said actuating means to effect a change in mode at a predetermined position of said variable length member.

25. A conversion press with automatic reject means comprising: a conversion press capable of forming a tab and attaching same to a closure through a multistep operation; a conveying means having uniformly spaced apart magazines to carry closures through said conversion press; an indexing drive means capable of indexing said conveying means in timed relation to the strokes of said conversion press; an upstacker located along said conveying means, said upstacker having a receiving means positioned above said conveying means and a reciprocating variable length stacking member operating in timed relation in said conveying means, said stacking member capable of assuming at least a first length and a second length, said first length being the normal operational length such that said stacking member contacts a closure and pushes it upward into said receiving station, said second length being shorter than said first length such that said stacking member is disabled from contacting closures; an actuating means to determine said first length or second length of the stacking member; a counter for counting press cycles, said counter being automatically resettable upon stoppage of said press; and wherein said actuating means is programmed to determine said second length of the stacking member upon stoppage of said press and said first length of the stacking member after a predetermined number of press cycles; and a proximity detector, in connection with said actuating means, for determining the position of said conversion press and wherein said actuating means is programmed to determine a change in length of said variable length stacking member at a predetermined position.

26. A method of rejecting closures produced during the start-up of a conversion press, said conversion press performing a multiple step operation on a closure being indexed therethrough, a completed closure being indexed through an upstacking station wherein a reciprocating member contacts the bottom side of the closure and pushes it upward into a receiving station, comprising the steps of: stopping said conversion press; shortening said reciprocating member sufficiently to disable said member from contacting said closure; starting said conversion press; indexing closures through the upstacking device; counting the number of cycles of said conversion press; monitoring the position of said reciprocating member; and lengthening said reciprocating member after a predetermined number of cycles, said lengthening being performed when said reciprocating member is at a predetermined position.

27. A method of rejecting defective closures from a conversion press, said conversion press performing a multistep tab forming and attachment operation to closures being indexed therethrough, the completed closures being indexed through an upstacking station wherein a reciprocating member contacts the bottom side of a closure and pushes it upward into a receiving station, comprising the steps of: testing for the presence of a tab on the completed closures; activating a counting means upon the testing of a defective closure; monitoring the position of said reciprocating member; and shortening said reciprocating member upon the appearance of a predetermined number in said counting means and lengthening said member after a single reciprocation, said lengthening and shortening being performed when said reciprocating member is at a predetermined position.

* * * * *